US006595676B2

(12) United States Patent
Starry

(10) Patent No.: US 6,595,676 B2
(45) Date of Patent: Jul. 22, 2003

(54) NOVELTY LIGHT

(76) Inventor: P. Douglas Starry, 17160 Ransom St., Holland, MI (US) 49424-1004

( * ) Notice: Subject to any disclaimer, the term of this patent is extended or adjusted under 35 U.S.C. 154(b) by 0 days.

(21) Appl. No.: 10/040,004

(22) Filed: Oct. 29, 2001

(65) Prior Publication Data

US 2002/0080605 A1 Jun. 27, 2002

Related U.S. Application Data

(60) Provisional application No. 60/246,666, filed on Nov. 8, 2000.

(51) Int. Cl.[7] ..... F21L 4/00

(52) U.S. Cl. ..... 362/569; 362/196; 362/208

(58) Field of Search ..... 362/810, 569, 362/276, 208, 212, 196, 186, 118, 255; 315/156, 185 R

(56) References Cited

U.S. PATENT DOCUMENTS 4,048,631 A * 9/1977 Flores ..... 340/321
4,187,532 A * 2/1980 Naffier ..... 362/186
5,161,879 A * 11/1992 McDermott ..... 200/60
5,519,593 A * 5/1996 Hasness ..... 362/186
5,683,350 A * 11/1997 Paul et al. ..... 362/186
5,957,566 A * 9/1999 Chiu ..... 362/190
6,066,924 A * 5/2000 Lederer ..... 315/185 R

* cited by examiner

*Primary Examiner*—Sandra O'Shea
*Assistant Examiner*—Hargobind S. Sawhney
(74) *Attorney, Agent, or Firm*—Miller, Johnson, Snell & Cummiskey, P.L.C.

(57) ABSTRACT

A method and apparatus are provided for simulating an open flame in a hand-held device. The method and the device resulting therefrom includes attaching a lamp to an electrical circuit contained within a housing, the circuit adapted to randomly vary at least one of a voltage, a current, and a resistance of a direct current supplied to said lamp by at least one battery, and transmitting the light from the lamp in at least a hemispherical pattern through a faceted cap surrounding said lamp.

16 Claims, 2 Drawing Sheets

NOVELTY LIGHT

CROSS REFERENCE TO RELATED APPLICATION

This application claims priority on provisional patent application serial No. 60/246,666, filed on Nov. 8, 2000, the contents of which are incorporated herein by reference.

BACKGROUND OF THE INVENTION

1. Field of the Invention

The invention relates generally to lights, and particularly to a novelty light which simulates the appearance of an open flame particularly useful to show appreciation to entertainers and the like.

2. Brief Description of the Related Art

Often times, fans at concerts and other entertainment venues express their appreciation of an artist's talents by holding up lit matches and lighters to create a multitude of small points of light. These displays are also believed to act as a sign the listeners would like the artist(s) to give an encore of their performance. However, the open flames can be dangerous. Flammable objects can come into contact with the open flame and ignite causing injury to bystanders, not to mention the possible spread of panic in congested and confined areas.

The primary purpose of this invention is to provide a simulated open flame using a hand-held device which does not offer the hazards of a lit match or ignited lighter. It is another object of this invention to provide a hand-held light or torch which produces a flickering light to simulate the appearance of an open flame. These and other objects of the instant invention will become more readily apparent to those skilled in the art when reviewing the summary of the invention, the detailed description, and in viewing the attached drawing figures.

SUMMARY OF THE INVENTION

According to one form of the invention, a method is provided for simulating an open flame in a hand-held device by attaching a lamp to an electrical circuit contained within a housing where the circuit is adapted to randomly vary at least one of a voltage, a current, and a resistance of a direct current supplied to the lamp by at least one battery. The open flame is simulated by transmitting light from the lamp in at least a hemispherical pattern through a faceted cap surrounding the lamp.

In another form of the invention, the method is carried out using a tubular housing having an opening in at least one end. A lamp is provided and extends from the opening in one end of the tubular housing. A circuit is disposed within the housing and is operably coupled to the lamp. The circuit randomly controls the intensity of the lamp. A transparent polyhedron-shaped cap attached to the end of the housing refracts the light rays emitted by the lamp to enhance the open flame appearance. Electrical power is provided to the lamp by at least one battery operably coupled to said circuit. A switch operably interconnects the battery to the lamp, and in a preferred embodiment, the switch extends through the housing for access by the operator. The simulated flickering of the lamp is achieved by a first clock circuit operating at a first clock speed, and a second clock circuit operating at a second clock speed different than the first clock. The different clock speeds may be provided using an integrated circuit.

Another form of the hand-held torch embodying the invention includes a housing having an internal cavity and an opening into the cavity through one end of said housing. A lamp extends through the opening and from the end of said housing where it is enclosed by a cap formed from at least a partially transparent material attached to the end of said housing. A circuit is disposed within the cavity of said housing and is operably coupled to the lamp. The circuit utilizes a specific device for randomly varying the intensity of the lamp to simulate the open flame. At least one battery is disposed within the cavity of the housing and may be retained by the circuit for selectively providing power to the lamp. A switch accessible by an operator is used to selectively provide the power from the battery to the lamp.

In yet another form of the invention, a hand-held light is provided which simulates an open flame. The light includes a tubular housing closed at one end and open at an opposite end. A lamp is provided which extends from the housing through the open end. A dedicated circuit is disposed within the housing and is operably coupled to the lamp and is configured to vary at least one of a current, a voltage, and a resistance of electricity provided to the lamp. The lamp is turned on and off by a switch operably coupled to the circuit which completes a connection with at least one battery disposed within the housing. Light from the lamp is dispersed in a generally hemispherical pattern by a multi-faceted canopy attached to the end of the housing.

These and other features, advantages, and objects of the present invention will be further understood and appreciated by those skilled in the art by reference to the following specification, claims, and appended drawings.

DESCRIPTION OF THE INVENTION

Figure 1:
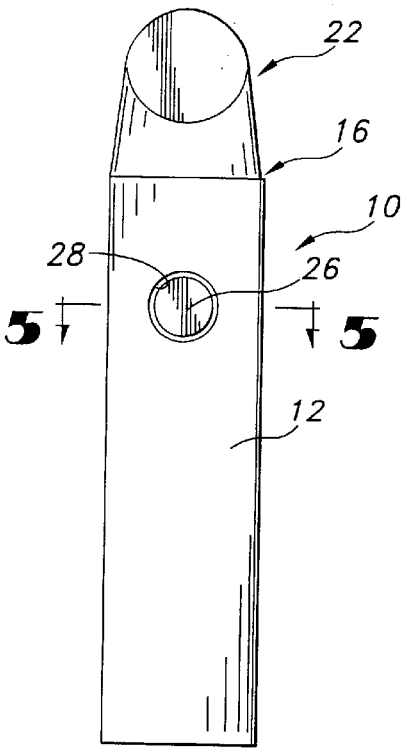
FIG. 1 is an elevation view of one form of the hand-held light embodying the invention.
Figure 2:
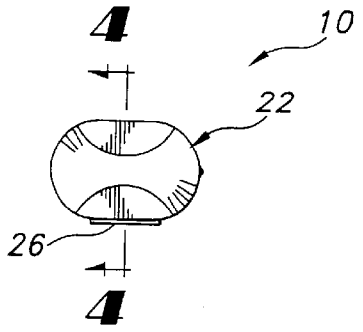
FIG. 2 is a plan view of the invention shown in FIG. 1.
Figure 3:
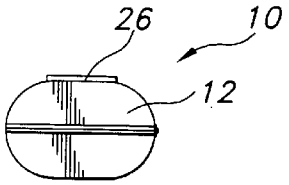
FIG. 3 is a bottom plan view of the invention shown in FIG. 1.

For purposes of the following description, the terms "upper," "lower," "left," "rear," "front," "vertical," "horizontal" and derivatives of such terms shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts. Specific dimensions and other physical characteristics relating to the embodiments disclosed herein are not to be considered as limiting, unless expressly stated otherwise.

According to one form of the invention, a method is provided for simulating an open flame by providing a hand-held device having a lamp which is operably coupled to an electrical circuit contained within a housing where the circuit is adapted to randomly vary at least one of a voltage, a current, and a resistance of a direct current supplied to the lamp by at least one battery. The open flame is simulated by transmitting light from the lamp in at least a hemispherical pattern through a polyhedron-shaped cap surrounding the lamp.

Another form of the hand-held torch embodying the invention includes a housing having an internal cavity and an opening into the cavity through one end of said housing. A lamp extends through the opening and from the end of said housing where it is enclosed by a faceted cap formed from at least a partially transparent material attached to the end of said housing. A circuit is disposed within the cavity of said housing and is operably coupled to the lamp. The circuit utilizes a specific device for randomly varying the intensity of the lamp to simulate the open flame. At least one battery is disposed within the cavity of the housing and may be retained by the circuit for selectively providing power to the lamp. A switch accessible by an operator is used to selectively provide the power from the battery to the lamp.

In yet another form of the invention, a hand-held light is provided which simulates an open flame. The light includes a tubular housing closed at one end and open at an opposite end. A lamp is provided which extends from the open end of the housing. A dedicated circuit is disposed within the housing and is operably coupled to the lamp and is configured to vary at least one of a current, a voltage, and a resistance of electricity provided to said lamp. The lamp is turned on and off by a switch operably coupled to the circuit which completes a connection with at least one battery disposed within the housing. Light from the lamp is dispersed in a generally hemispherical pattern by a multi-faceted canopy attached to the end of the housing.

FIGS. 1–6 illustrate one embodiment of the invention wherein the hand-held light or torch 10 includes a tubular housing 12 having an opening 14 in at least one end 16. A lamp 18 is provided which extends from the opening 14 in the end 16 of the tubular housing 12. A circuit 20 is disposed within an internal cavity 21 defined in the tubular housing 12 and is operably coupled to the lamp 18. The circuit 20 randomly controls the light intensity of the lamp 18. A transparent polyhedron-shaped cap 22 attached to the end 16 of the tubular housing 12 refracts the light rays emitted by the lamp 18 to enhance the open flame appearance. Electrical power is provided to the lamp 18 by at least one battery 24 operably coupled to said circuit 20. A switch 26 operably interconnects the battery 24 to the lamp 18, and in a preferred embodiment, the switch 26 extends through an opening 28 in the tubular housing 12 for access by the operator.

Figure 4:
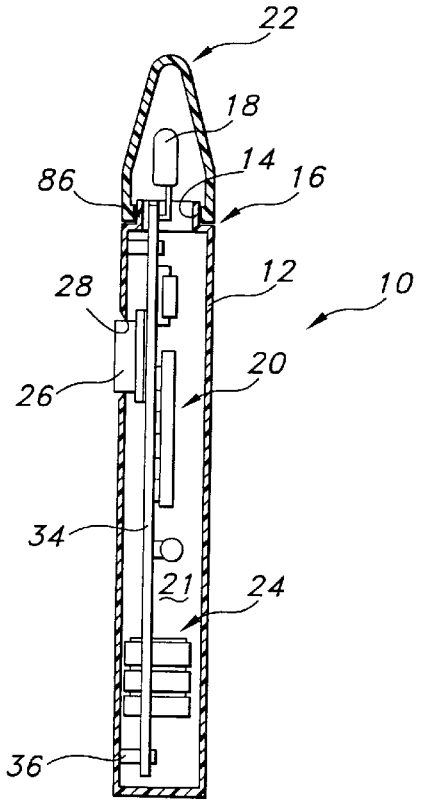
FIG. 4 is a section view of the invention, taken along line IV—IV shown in FIG. 2.
Figure 6:
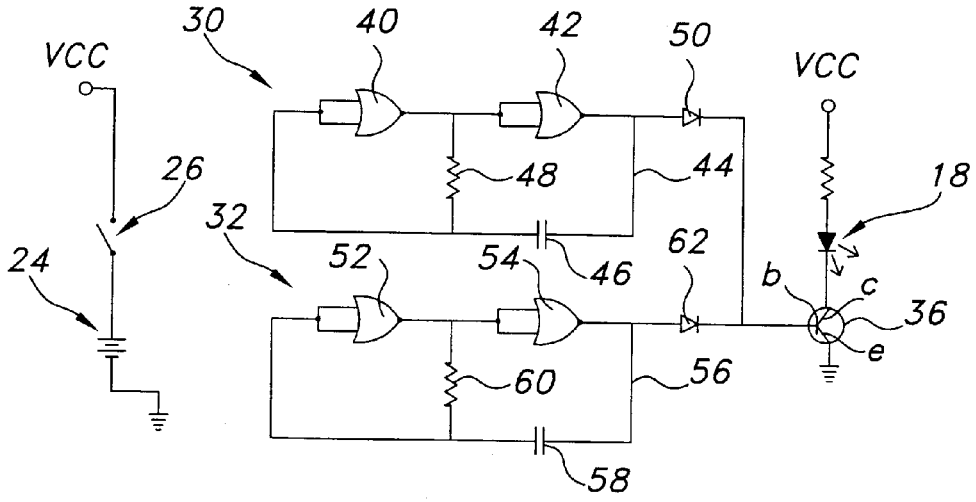
FIG. 6 is a schematic diagram illustrating one embodiment of a circuit to be used in combination with the instant invention.

The simulated flickering of the light produced by the lamp 18 is controlled by circuit 20 briefly mentioned above, and is best illustrated in FIGS. 4 and 6. With reference to FIG. 4, it is preferred circuit 20 include a circuit board 34 mounted onto pins 36 extending into the interior of the tubular housing 12. The circuit board 34 contains one or more conductors defined thereon using conventional methods wherein various electronic components may be attached. For example, and as best illustrated in FIG. 6, the lamp 18 may include a conventional light emitting diode (LED) which is coupled through a transistor 36 generally designated as an SOT-23 available from General Semiconductor. Transistor 36 is in turn coupled to the negative pole of the battery 24 with the base of the transistor 36 connected to receive signals from two clock circuits generally designated in FIG. 6 by reference numbers 30 and 32. A first clock circuit 30 is intended to operate at a first predetermined clock speed in the range of 0.01 to 0.001 second, while the second clock circuit 32 operates at a second clock speed different from that of the first clock but within the same range designated above. The purpose of the different clock speeds is to vary the amount of one of a current, voltage, or resistance of the power provided to the lamp 18 which directly impacts the intensity of the lamp 18. The circuit 20 is not intended to interrupt power provided to lamp 18 as would a switch, but simply to control the amount or potential to change the light intensity or brightness.

FIG. 6 is a schematic which may be used to technically describe the basic components of the circuit 20. However, it should be understood that some or many of the components functions can be provided by one or more integrated circuit chips such as MC74ACO2D available from Motorola Corp. However, generally speaking, clock circuit 30 includes a first OR gate 40, the output of which is coupled to the input of a second OR gate 42. The output of the second OR gate 42 is passed back through line 44 to a capacitor 46 which is connected to the input side of OR gate 40, and through resistor 48 to the input of OR gate 42. The output of OR gate 42 is also coupled via diode 50 to the base of transistor 36.

Also connected to the base of transistor 36 is the second clock circuit 32. Clock circuit 32 also includes an OR gate 52 having its output connected to the input of a second OR gate 54. The output of OR gate 54 is coupled by line 56 to a capacitor 58 which is in turn coupled to the input side of OR gate 52, and to the input of OR gate 54 via resistor 60. A diode 62 interconnects the two OR gates 52, 54 to the base of the transistor 36. As recognized by those of skill in the art of electronics, the diodes 50 and 62 prevent the output signal of one clock circuit such as 30 from providing an input to clock circuit 32, but only to the base of transistor 36.

Figure 5:
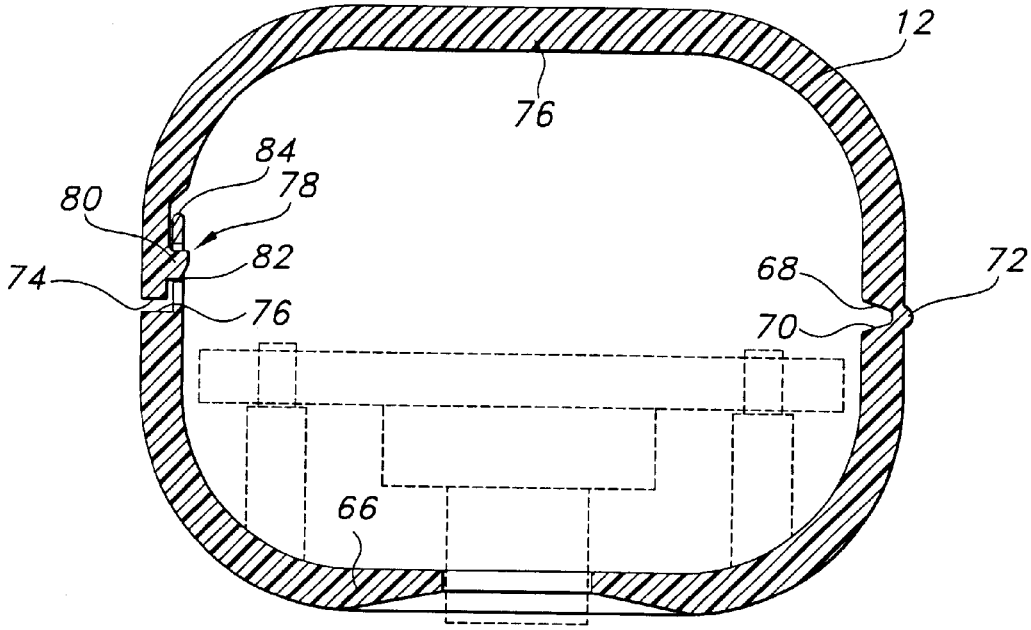
FIG. 5 is an enlarged transverse section view of the invention, taken along line V—V shown in FIG. 1.

It is anticipated the electronic circuitry generally referenced by numeral 20 may be manufactured relatively inexpensively, such that it may be permanently enclosed within the tubular housing 12. In the preferred embodiment, tubular housing 12 is manufactured from a polymeric material such as nylon or polypropylene. Using such materials, the preferred manufacturing method is by injection molding where a predetermined number of components could be produced at one time. In an initial form of the invention, tubular housing 12 was formed from two components, one being the tube body and a second being an end cap for sealing one of the ends. However, after further investigation, it was determined the preferred method of manufacture was to make the housing as a one-piece unit such as shown in FIG. 5. The figure illustrates a transverse cross section of the tubular housing 12 shown in FIG. 1, but with the contents of the circuit board 20 removed for purposes of clarity. It is preferred the tubular housing 12 have a first half 64 coupled to a second half 66 along an edge 68, 70, and interconnected by a living hinge 72. The opposite edges or sides 74 and 76 are configured to mate together using one or more latches 78. As shown in FIG. 5, a detent 80 extends from the inner surface of half 64 proximate edge 74 which is designed to engage a recess 82 formed in a projection 84 extending from the other edge 76. It is contemplated to seal the tubular housing 12, a plurality of such latching structures would be provided along the length of the mating edges 74, 76. Thus, once snapped together enclosing the circuit 20 along with its components, the housing is fairly securely closed.

A similar snap-fit connection is provided to secure the polyhedron-shaped cap 22 to the end 16 of the tubular housing 12. Referring back to FIG. 2, the end 16 includes a neck portion 86 having a plurality of small bosses or detents which are configured to engage in positive locking engagement with corresponding mating structures formed on the inner surface of the polyhedron-shaped cap 22. It is preferred that once the polyhedron-shaped cap 22 is inserted into snap-fitting engagement, it would be difficult, although not impossible to remove. It is contemplated that polyhedron-shaped cap 22 can also be manufactured from an injection molded polymeric material such as crystal styrene or other light transmitting material. Glass may also be used, but is not preferred because of the cost, weight, and safety considerations.

This light, also referred to as a torch, will simulate the flame of a cigarette lighter, match, or candle flame when power is provided to the lamp 18 via the switch 26. In this manner, the user can simulate the light produced by an open flame without worrying about the proximity of the light to clothing or hair. Because the device is intended to be sealed upon manufacture, it is intended to be disposable in nature. However, because the units can be opened, the components could be salvaged and recycled if desired.

The size of the unit could also be varied, depending upon the specific needs. It is preferred the overall size of the light not exceed the size of a disposable cigarette lighter. Such a size makes it easy to handle and store, and precludes the light from having substantial mass which could cause injury to others. Other variations could also be made to the light as disclosed herein. The clear plastic cover may be removed and replaced with different colored transparent covers for different effects.

The above description is considered to be that of the preferred embodiment only. Modifications of the invention will occur to those skilled in the art and to those who make or use the invention. Therefore, it is understood that the embodiment shown in the drawing figures and described above are merely for illustrative purposes and not intended to limit the scope of the invention unless expressly stated herein, or a limited by the following claims as interpreted according to the principles of patent law, including the doctrine of equivalents.

I Claim:

1. A novelty light, comprising:

a tubular housing having an opening in at least one end;

a lamp extending from said opening in said at least one end of said tubular housing;

a circuit disposed within said tubular housing and operably coupled to said lamp for randomly controlling an intensity of said lamp when powered, said circuit having a first clock circuit operating at a first clock speed and a second clock circuit operating at a second clock speed different than said first clock speed;

a transparent polyhedron-shaped cap attached to said at least one end of said tubular housing and enclosing said lamp;

at least one battery operably coupled to said circuit for providing power to said lamp; and a switch operably interconnecting said at least one battery in said circuit to said lamp.

2. The novelty light as defined in claim 1, wherein said lamp includes at least one of a light emitting diode and an incandescent lightbulb.

3. The novelty light as defined in claim 1, wherein said tubular housing is formed from two interconnecting halves.

4. The novelty light as defined in claim 1, wherein said circuit includes an integrated circuit.

5. The novelty light as defined in claim 1, wherein said polyhedron-shaped cap includes a snap-fit connection adapted to mate to said at least one end of said tubular housing.

6. A hand-held torch for simulating an open flame, comprising:

a housing having an internal cavity and an opening into said internal cavity through one end of said housing;

a lamp extending through said opening and from said end of said housing;

a circuit disposed within said internal cavity of said housing, and operably coupled to said lamp for randomly varying an intensity of said lamp to simulate the open flame; and a faceted cap, formed from at least partially transparent material, attached to said one end of said housing and over said lamp, for refracting rays of light emitting from said lamp.

7. The hand-held torch as defined in claim 6, further including at least one battery disposed within said internal cavity of said housing and operably coupled to said circuit.

8. The hand-held torch as defined in claim 6, further including a switch operably coupled to said circuit for selectively providing power to said lamp.

9. The hand-held torch as defined in claim 6, further including at least one device on said circuit for varying the amount of one of a current, a voltage, and a resistance of power to said lamp.

10. The hand-held torch as defined in claim 6, wherein said housing and said cap are formed from a polymeric material.

11. A hand-held torch for simulating an open flame, comprising:

a housing having an internal cavity and an opening into said internal cavity through one end of said housing;

said housing including a first and a second half interconnected together along one edge by a hinge, and along a second edge by at least one clasp;

a lamp extending through said opening and from said end of said housing;

a cap, formed from at least partially transparent material, attached to said one end of said housing and over said lamp.

12. A hand-held light simulating an open flame, comprising in combination:

a tubular housing closed at one end and open at an apposite end;

a lamp extending from said opposite end;

a circuit disposed within said tubular housing and operably coupled to said lamp through said opposite end, said circuit configured to vary at least one of a current, a voltage, and a resistance of electricity provided to said lamp;

a switch operably coupled to said circuit for selectively providing power to said lamp;

at least one battery operably coupled to said circuit for providing electrical power to said circuit and said lamp; and a multi-faceted canopy made from a light transmitting material and attached to said opposite end of said tubular housing for enclosing said lamp extending from said opposite end of said tubular housing, and permitting light to radiate from said lamp in a plurality of directions contained pt least within a hemispherical region defined around said opposite end.

13. The hand-held light as defined in claim 12, further comprising a device in said circuit for randomly varying said at least one of a voltage, a current, and a resistance of said electricity to said lamp.

14. The hand-held light as defined in claim 12, further comprising a first and a second clocking system in said circuit for randomly varying an intensity of light produced by said lamp.

15. The hand-held light as defined in claim 12, wherein said circuit and lamp are permanently sealed enclosed by said tubular housing and by said multi-faceted canopy.

16. A method for simulating an open flame in a hand-held device, comprising the step of attaching a lamp to an electrical circuit contained within a housing, said circuit adapted to randomly vary at least one of a voltage, a current, and a resistance of a direct current supplied to said lamp by at least one battery, and transmitting light from said lamp in at least a hemispherical pattern through a faceted cap surrounding said lamp.

* * * * *